United States Patent [19]

Micallef

[11] 3,995,776

[45] Dec. 7, 1976

[54] DIRECT FINGER ACTUATED PUMP

[75] Inventor: Lewis A. Micallef, Fort Lee, N.J.

[73] Assignee: Leeds and Micallef, Fort Lee, N.J.

[22] Filed: Sept. 16, 1975

[21] Appl. No.: 613,820

[52] U.S. Cl. ..... 222/207
[51] Int. Cl.[2] ..... B65D 37/00
[58] Field of Search ..... 222/207, 209

[56] References Cited

UNITED STATES PATENTS

| | | | |
|---|---|---|---|
| 1,392,601 | 10/1921 | Rose | 222/207 |
| 1,542,584 | 6/1925 | Rose | 222/207 |
| 3,029,742 | 4/1962 | Curtis | 222/207 X |
| 3,486,663 | 12/1969 | Humphrey | 222/207 |
| 3,752,366 | 8/1973 | Lawrence, Jr. | 222/207 |
| 3,820,689 | 6/1974 | Cocita | 222/207 |

*Primary Examiner*—Allen N. Knowles
*Attorney, Agent, or Firm*—Kane, Dalsimer, Kane, Sullivan and Kurucz

[57] ABSTRACT

A manually operable liquid dispensing pump for use and incorporation on a container for liquid to be dispensed includes a component retaining body and a tubular member carried by the body having a flexible wall defining a variable volume pump chamber adapted to assume a fully distended position of maximum volume and a collapsed position of lesser volume. The retaining body has an aperture therethrough and a portion of the tubular member extends through the aperture to permit manual engagement therewith. Depressing the projection flexes the wall of the tubular member and reduces the volume of the pump chamber thereby pressurizing liquid to be dispensed in the pump chamber and, at the same time, with an inlet valve closed, causes an outlet to open whereupon the liquid in the pump chamber is adapted to flow into an outlet port and be dispensed therefrom. Release of the projection permits the tubular member to return to its starting position and permits the volume of the pump chamber to increase thereby lowering the pressure in the pump chamber and, at the same time, with the outlet valve closed, causes the inlet to open whereupon the liquid to be dispensed is drawn through an inlet port into the pump chamber until the flexible wall of the tubular member reaches its distended position whereupon the inlet valve closes to trap the liquid to be dispensed in the pump chamber.

12 Claims, 5 Drawing Figures

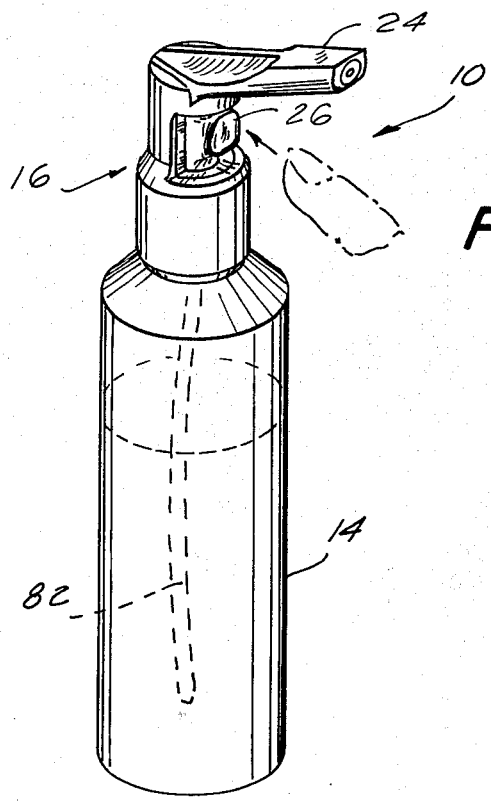
FIG. 1
FIG. 3
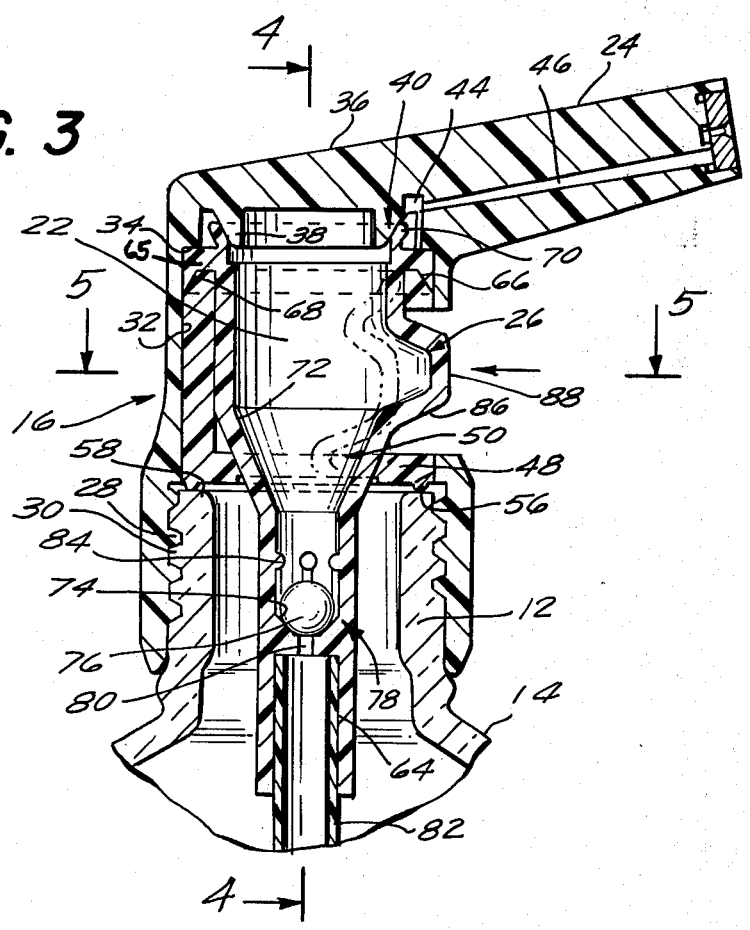

DIRECT FINGER ACTUATED PUMP

BACKGROUND OF THE INVENTION

There has always been an ever increasing need insofar as consumer products are concerned for pumps of better construction and superior as well as efficient performance, but, most of all, urgent need presently exist for pumps having such characteristics but of significantly simple design and construction that are materially lower in cost of construction, manufacture and assembly and which are versatile in structure and use. An example of a pump of the type that satisfies this need is disclosed in U.S. Pat. No. 3,749,290.

Within the recent past and continuing on into the present, there have been a number of different types of trigger actuated pumps for handling and dispensing materials of a wide variety as those commonly marketed in the cosmetic, toiletry, food, agricultural and industrial products fields. As the market develops, there has also appeared a need for a pump actuating means which is triggerless in nature and which relies upon a squeeze type action to actuate the pump. The present invention relates to fluid dispensing pumps or containers such as the pump described in U.S. Pat. No. 3,479,290 and which utilizes a triggerless mechanism for actuation. In fact, the design is such that the actuating mechanism includes no rigid projecting portions from the pump structure and in fact is formed integrally with the parts forming the pump structure with no additional components being necessary. It is easily and efficiently operated by a simple finger depression through an appropriate aperture in the housing.

SUMMARY OF THE INVENTION

With the above background in mind, it is accordingly, among the principal objectives of the present invention to provide a triggerless actuated dispensing pump which is housed in a compact leakproof structure and which is easily and efficiently adapted for interconnection with a container and fluid held within the container to operate in a reciprocal manner in pumping fluid from the container and dispensing the fluid in the desired manner. The structure is such that the actuating means is in the form of a squeeze bulb type of structure whereupon simple finger depression and release of the bulb will reciprocate the bulb through an appropriate aperture in the pump body to actuate the pump in a reciprocal fashion and dispense fluid from the container. The triggerless mechanism is designed for use with a variety of different types of reciprocally operable pumps whereupon depression and release of the actuator operates the appropriate pump and valve structure in the desired fashion. One such pump arrangement is present in the depicted and described embodiment. As shown, the pump body is provided with an aperture in alignment with a laterally extending nozzle with a bulbous projection of the inner flexible tubular member extending normally through the aperture in the body so that when the pump is grasped the nozzle can be easily pointed in the desired direction and the projection depressed and released in reciprocal fashion to vary the volume of the interior of the tubular member and operate the pump.

In summary, a manually operable liquid dispensing pump for use and incorporation on a container for a liquid to be dispensed is provided. The pump includes a component retaining body and a tubular member carried by the body and having a flexible wall defining a variable volume pump chamber adapted to assume a fully distended position of maximum volume and a collapsed position of lesser volume. Operating means are on the body to permit access to the flexible wall of the tubular member for manually engaging and flexing the flexible wall from its distended position to its collapsed position and permitting the return of the wall to its distended position when the flexible wall is manually released. A liquid inlet port and outlet port are provided with both being in communication with the pump chamber and having, respectively, an inlet valve and an outlet valve associated therewith. The inlet valve is adapted to be closed when liquid to be dispensed is in the pump chamber and when it is dispensed therefrom as the pump chamber decreases in volume and adapted to be opened when the liquid to be dispensed in drawn into the pump chamber from the inlet port as the pump chamber volume increases. The outlet valve is adapted to open when the pump chamber decreases in volume as the liquid therein is dispensed out the outlet port and is adapted to close when the pump chamber increases in volume. The operating means permits engagement with the flexible wall of the tubular member by manual depression thereof to reduce the volume of the pump chamber thereby pressurizing liquid to be dispensed in the pump chamber and, at the same time, with the inlet valve closed, causes the outlet valve to open whereupon the liquid in the pump chamber is adapted to flow into the outlet port and be dispensed therefrom. The operating means permits manual release of the tubular member and permits it to return to and resume its starting position. This action permits the volume of the pump chamber to increase thereby lowering the pressure in the pump chamber and, at the same time, with the outlet valve closed, causes the inlet valve to open whereupon the liquid to be dispensed in drawn through the inlet port into the pump chamber until the flexible wall of the tubular member reaches its distended position whereupon the inlet valve closes to trap the liquid to be dispensed in the pump chamber. The operating means includes an opening in the retaining body and an integral bulbous projection portion of the tubular member normally extended through the opening to permit manual engagement therewith and reciprocation of the bulbous portion through the opening to operate the pump.

Other objectives and advantages will become apparent from the following detailed description which is to be taken in conjunction with the accompanying drawings illustrating a somewhat preferred embodiment of the invention.

BRIEF DESCRIPTION OF THE DRAWINGS

In the Drawings:

FIG. 1 is a perspective view of the pump fitted on the neck of a container for liquid to be dispensed;

FIG. 3 is a longitudinal sectional view of the pump shown associated with the neck of the container with the bulbous tubular member defining the pump chamber shown in a fully distended position and shown in the collapsed position in phantom;

DESCRIPTION OF THE PREFERRED EMBODIMENT

Figure 2:
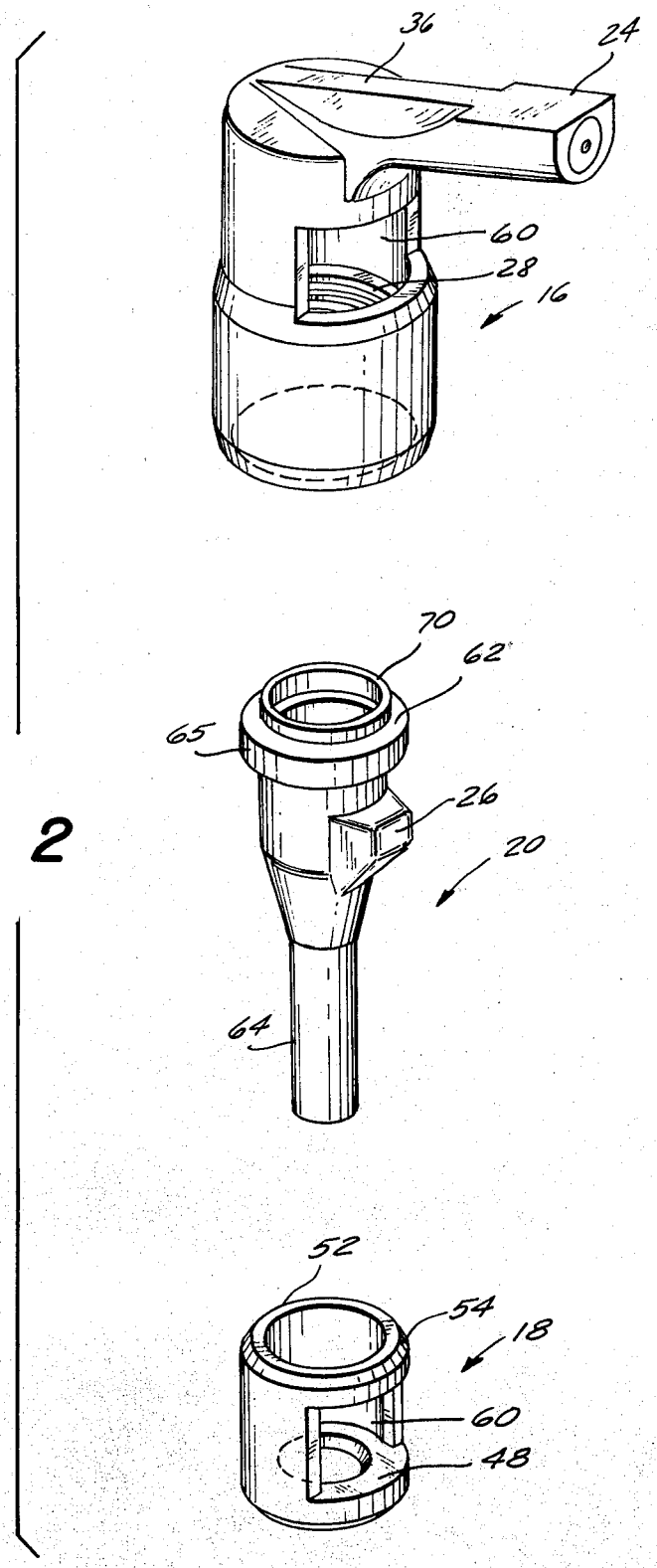
FIG. 2 is an exploded perspective view of the component parts of the pump drawn to an enlarged scale.
Figure 4:
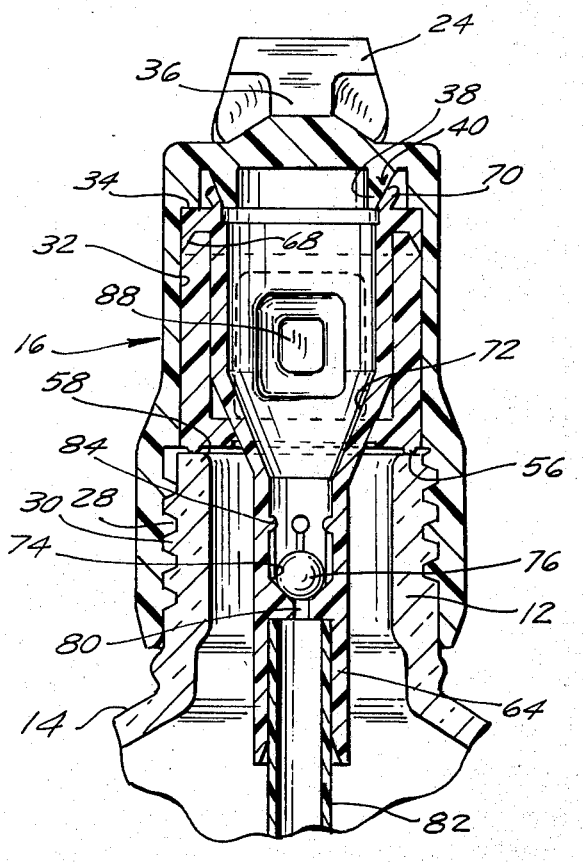
FIG. 4 is a sectional end view thereof taken along the plane of line 4—4 of FIG. 3.
Figure 5:
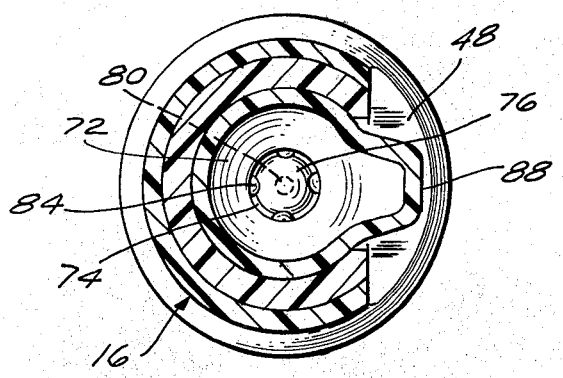
FIG. 5 is a sectional top view thereof taken along the plane of line 5—5 of FIG. 3.

In the drawings, pump 10 is shown on the neck 12 of a container 14 having the selected liquid to be dispensed. The pump includes an outer shell 16 and associated shell 18 both of which define a component retaining body, an interior flexible tubular member 20 defining pump chamber 22, and a dispensing nozzle 24 which may form an integral part of the outer shell 16.

The outer shell 16 serves to couple the pump to the neck 12 of the container and, consequently, is formed with internal threads 28 which mate with the external threads 30 on the neck 12 of the container 14. In an alternative arrangement the shell 16 may be crimped over a bead on the neck of the container in lieu of the threaded connection. The internal cylindrical wall 32 of shell 16 is furnished with a rather close fit with the outer wall of shell 18 for securely fastening therbetween the upper end of the tubular member 20. In this connection, the annular shoulder 34 of the outer shell engages with the associated upper surfaces of the tubular member 20. In addition, a top 36 of the outer shell is provided with an annular downwardly depending lip 38 which cooperates with associated surfaces on the upper end of the tubular member 20 in defining the upper outlet valve 40. The top 36 of the outer shell 16 extends into the integral outwardly depending nozzle 24 and is furnished with a passageway 44 which communicates with the discharge orifice 46 of the nozzle 24. It should be understood that nozzle 24 may be furnished with any one of a series of known dispensing nozzle configurations for purposes of providing the desired discharge pattern of the contained liquid to be dispensed.

The inner shell 18 is tubular in configuration and cooperates with the outer shell 16 in securing the upper end of the inner tubular member and at the same time is provided with a radially inwardly extending flange 48 which cooperates with associated surfaces of the tubular member 20 in defining the air inlet valve 50 which permits air to be introduced into the interior or head space of the container 14 to replenish liquid drawn into the pump chamber 22. The upper end 52 of the inner shell includes an outer annular and beveled face 54 which receives a correspondingly shaped surface of the upper end of the tubular member 20 to facilitate anchoring the tubular member 20 between the outer shell 16 and inner shell 18. The base of the inner shell 18 is provided with an annular sealing lip 56 which engages with the upper lip 58 of the neck 12 of the container 14. As will be appreciated, this seal is effectuated upon screwing the outer shell completely upon the neck 12. The inner shell 18 together with the outer shell 16 define operating means in the form of aligned respective openings to form through opening 60 through which a bulbous projecting portion 26 extends so as to be manually engaged and depressed and released reciprocally through opening 60 and thereby travel in changing the volume of the pump chamber 22 during the pumping cycle. Where desired or necessary a trigger may be pivotally or hingedly suspended in any suitable manner, as for example, from the nozzle 24, so that it is adapted to engage the bulbous portion 26 and be itself manually engaged to accomplish the pumping cycle.

The tubular member 20 is constructed of any one of many moldable flexible materials of either snythetic or natural resin or plastic and is essentially elastomeric in nature. The upper end 62 of the tubular member 20 is largely in diameter than the lower end 64 and is provided with an outwardly extending radial flange 65 which terminates in a downwardly depending annular apron 66 having an inner beveled face 68 which meets with the beveled face 54 at the upper end of the inner shell 18. It will be noted in FIG. 3 that the periphery of the flange 65 and the apron 66 are disposed between the adjacent surfaces of the inner shell 18 and outer shell 16 to lock the tubular member in place. The upper end 62 of the tubular member 20 is also provided with an upwardly extending annular sealing lip 70 which cooperates with the lip 38 at the upper end 36 of the outer shell 16 in defining the outlet valve 40, the opening and closing of which will be described in detail shortly. The intermediate part of the tubular member 20 is defined by a tubular bulbous sidewall 72 which defines the pump chamber 22. A portion of the circumference of sidewall 72 extends beyond the remainder of the sidewall to form a larger bulbous projection 26 which extends through opening 60 and cooperates therewith in permitting operation of the pump.

The lower end 64 of the tubular member 20 defines an annular valve seat 74 which cooperates with ball 76 in defining an inlet check valve 78 for sealing liquid in the pump chamber 22 and at the same time permits passage therethrough of liquid from the container interior into the pump chamber 22. Any one of a number of projections 80 may be adapted below the valve seat 74 to assure against the ball being forced or driven down into the lower end 64 of the tubular member 20 or perhaps into the dip tube 82. The dip tube 82 is suitably connected to the bottom end 64 of tubular member 20 and serves to direct the liquid from the interior of the container 14 into the pump chamber 22. Projections 84 may also be provided on the interior of the tubular member 20 above the ball 76 to limit the extent of upward travel of the ball 76 to limit the extent of upward travel of the ball when unseated. The exterior surface of the bulbous sidewall 72 cooperates with adjacent surfaces of the radial flange 48 in defining an air inlet valve 50 as explained above.

Bulbous projection 26 is formed of four integral interconnected laterally projecting trapezoidal shaped sidewalls 86 terminating in a flat rectangular shaped end wall 88. End wall 88 forms a convenient engaging surface for depression of tubular member 72 and corresponding operation of pump 10. Naturally, the configuration of bulbous projection 26 is a matter of choice and can be altered as desired as long as it is a sufficient projection to extend through opening 60 and permit manual engagement thereof. It should also be noted that the projection 26 and the opening 60 through which it extends are aligned with nozzle 24. This alignment facilitates grasping of the pump and container assembly and pointing of the nozzle in the desired direction with ease of accompanying depression of projection 26 by the holder's finger or fingers to operate the pump in dispensing fluid accurately and easily in the desired direction with one or repeated pumping operations by reciprocation of bulbous projection 26.

Assuming the disposition of parts shown in FIG. 3 and the pump chamber 22 filled with liquid to be dispensed, the valves 40, 78 and 50 will be closed. When it is desired to dispense the liquid contents of the pum chamber 23, flat surface 88 of bulbous projection 26 is actuated by applying finger pressure thereon while directing the nozzle in the appropriate direction. The projection 26 moves inwardly through opening 60 thereby depressing or collapsing the bulbous sidewall 72 to the position shown in phantom in FIG. 3. At the outset and during this movement, the ball 76 will be forced into tighter engagement with its seat 74 and the pressure of the contained liquid in chamber 22 will force the lips 70 at the upper end of the tubular member 20 away from its associated lip 38 out of the outer shell 16 to open the valve 40. The pressurized liquid in pump chamber 22 will be forced out through the outlet opening thus provided by the open valve 40 into the opening 44 and out through the discharge orifice 46 of the nozzle 24. Upon release of the bulbous projection 26, the elastic properties of the bulbous sidewall 72 will urge tubular member 20 and particularly its side walls to return to its initial and normal molded condition. At the initiation of this return movement and throughout this return movement, the valve 40 will close automatically and the negative pressure within the pump chamber 22 will cause the ball 76 to unseat from its accommodating seat 74. This negative pressure will draw liquid from the interior of the container 14 up through the dip tube 82 into the pump chamber 22 until the bulbous sidewall 72 assumes its fully distended position as shown in FIG. 3. Throughout this excursion, the liquid that is drawn up into the pump chamber 22 is replaced by air which is permitted to enter the container interior or head space through the opened valve 50. When the pump chamber 22 is filled, the valve 78 will close as well as the air inlet valve 50. When it is desired to dispense more of the liquid contents, the bulbous projection 26 is actuated as often as desired and the pumping cycle will be repeated.

Thus, the several aforenoted objects and advantages are most effectively attained. Although a single preferred embodiment of the invention, has been disclosed and described in detail herein, it should be understood that this invention is in no sense limited thereby and its scope is to be determined by that of the appended claims.

What is claimed is:

1. A liquid dispensing pump for use and incorporation on a container for liquid to be dispensed comprising in combination:

a component retaining body having an upper end and a lower end and having a lateral opening;

a tubular member carried by said body having a flexible wall defining a variable volume pump chamber adapted to assume a fully distended position of maximum volume and a collapsed position of lesser volume, a lateral bulbous projection portion of the tubular member extending through the opening of the retaining body so that the bulbous projection can be manually and digitally engaged and depressed through the opening in the retaining body thereby decreasing the volume in the pump chamber and when the bulbous projection is released it will return through the opening to its initial position and return the pump chamber to its initial fully distended position of maximum volume;

a lower liquid inlet port and an upper outlet port both being in communication with the pump chamber and having, respectively, an inlet valve and an outlet valve associated therewith, said inlet valve adapted to be closed when liquid to be dispensed is in the pump chamber and when it is dispense therefrom as the pump chamber decreases in volume and adapted to be opened when the liquid to be dispensed is drawn into the pump chamber from the inlet port as the pump chamber volume increases and said outlet valve adapted to open when the pump chamber decreases in volume as the liquid therein is dispensed out the outlet port and adapted to close when the pump chamber increases in volume;

digital actuation of the projection portion permitting movement of the flexible wall of the tubular member to reduce the volume of the pump chamber thereby pressurizing liquid to be dispensed in the pump chamber and, at the same time, with the inlet valve closed, causing the outlet valve to open whereupon the liquid in the pump chamber is adapted to flow into the outlet port and be dispensed therefrom; and release of the projection portion permitting the tubular member to return to and resume its starting position permitting the volume of the pump chamber to increase thereby lowering the pressure in the pump chamber and, at the same time, with the outlet valve closed, causing the inlet valve to open whereupon the liquid to be dispensed is drawn through the inlet port into the pump chamber until the flexible wall of the tubular member reaches its distended position whereupon the inlet valve closes to trap the liquid to be dispensed in the pump chamber.

2. The invention in accordance with claim 1 wherein the bulbous projection is in the form of a integrally formed portion of the wall of the tubular member extending laterally in rectangular form with trapezoidal shaped sidewalls and terminating in a flat rectangular shaped end wall to facilitate engagement therewith for actuation thereof.

3. The invention in accordance with claim 1 wherein air network means are provided for permitting the passage of air from the ambient into the container to replenish the volume of the liquid to be dispensed which is drawn from the container interior into the pump chamber through the inlet port.

4. The invention in accordance with claim 1 wherein the container comprises a neck defining an opening and said pump extending across the opening defined by the neck, the component retaining body being in the form of a cap connected with the container neck.

5. The invention in accordance with claim 1 wherein the tubular body includes a radially extending flange at the top which cooperates with the component retaining body and providing a seal which isolates the pump chamber from the outlet port and the path of travel of the liquid dispensed out of the outlet port.

6. The invention in accordance with claim 1 wherein the component retaining body includes means for connecting the pump across the opening of a container and a discharge nozzle extending in a lateral direction, the discharge nozzle defining said outlet port.

7. The invention in accordance with claim 6 wherein the opening and bulbous projection being vertically aligned with the discharge nozzle to facilitate gripping of the pump and directing the nozzle in the desired direction and depressing and releasing the bulbous projection to operate the pump.

8. The invention in accordance with claim 1 wherein the component retaining body is comprised of an inner and outer shell connected with one another and threaded means on one of said shells for threadedly coupling the pump to the threaded neck of a container.

9. The invention in accordance with claim 8 wherein one of the shells includes include sealing means for sealing the pump across the neck of the container.

10. The invention in accordance with claim 1 wherein the lower end of the tubular member defines a valve seat for the inlet valve, the inlet valve including a ball adapted to rest on the valve seat, means for preventing the ball from being forced out of the tubular member into the container, and means for limiting the movement of the ball away from the valve seat when the inlet port is opened.

11. The invention in accordance with claim 10 wherein the lower end of the tubular member includes means for coupling with a dip tube.

12. The invention in accordance with claim 1, wherein a trigger means is in operative engagement with the bulbous projection to cause depression thereof through the opening in the retaining body when the trigger is pulled to thereby decrease the volume in the pump chamber and when the trigger means is released the bulbous projection is adapted to return through the opening to its initial position and return the pump chamber to its initial volume.

* * * * *

UNITED STATES PATENT OFFICE

CERTIFICATE OF CORRECTION

PATENT NO. : 3,995,776

DATED : December 7, 1976

INVENTOR(S) : Lewis A. Micallef

It is certified that error appears in the above-identified patent and that said Letters Patent are hereby corrected as shown below:

In the abstract, line 15 after "outlet" insert --valve--;

Column 2, line 17, "in" should be --is--;

Column 2, line 37, "in" should be --is--;

Signed and Sealed this

Fifth Day of April 1977

[SEAL]

*Attest:*

RUTH C. MASON
*Attesting Officer*

C. MARSHALL DANN
*Commissioner of Patents and Trademarks*